US006895714B2

(12) United States Patent
Teubert et al.

(10) Patent No.: US 6,895,714 B2
(45) Date of Patent: May 24, 2005

(54) COMPRESSION MOUNTING SYSTEM FOR SHOWER DOORS

(75) Inventors: John A. Teubert, Sheboygan Falls, WI (US); Brian D. Cowell, Fond du lac, WI (US); Alice M. Jandrisits, Des Plains, IL (US); Raul M. Paredes, Barrington, IL (US); Michael T. Seum, St. Joseph, MI (US)

(73) Assignee: Kohler Co., Kohler, WI (US)

( * ) Notice: Subject to any disclaimer, the term of this patent is extended or adjusted under 35 U.S.C. 154(b) by 0 days.

(21) Appl. No.: 10/777,826

(22) Filed: Feb. 12, 2004

(65) Prior Publication Data

US 2004/0159049 A1 Aug. 19, 2004

Related U.S. Application Data

(62) Division of application No. 09/846,010, filed on Apr. 30, 2001, now Pat. No. 6,701,672.

(51) Int. Cl.[7] ..... E06B 1/04

(52) U.S. Cl. ..... 49/505; 49/406; 49/411; 4/600

(58) Field of Search ..... 049/504, 505, 049/404, 406, 411, 413; 52/217; 4/596, 599, 600, 612

(56) References Cited

U.S. PATENT DOCUMENTS

| | | | | |
|---|---|---|---|---|
| 2,159,666 | A | 5/1939 | Lotz | |
| 2,856,040 | A | 10/1958 | Dansereau | |
| 3,553,891 | A | 1/1971 | Casebolt et al. | |
| 4,031,665 | A | 6/1977 | Abramson | |
| 4,035,957 | A | 7/1977 | Roloff | |
| 4,286,343 | A | 9/1981 | Lampka | |
| 4,333,272 | A | 6/1982 | Eastman | |
| 4,372,082 | A | 2/1983 | Pagel | |
| 4,453,346 | A | 6/1984 | Powell et al. | |
| 4,679,373 | A | 7/1987 | Ludwig | |
| 4,698,944 | A | 10/1987 | Wilkins, Jr. | |
| 4,769,862 | A | 9/1988 | Skrzelowski | |
| 4,887,394 | A | 12/1989 | Marlowe | |
| 5,033,132 | A | 7/1991 | Greenblatt | |
| 5,822,810 | A | 10/1998 | Chen | |
| 6,530,186 | B2 * | 3/2003 | Torstensen | 52/217 |

FOREIGN PATENT DOCUMENTS

DE 3524891 A1 1/1987

* cited by examiner

*Primary Examiner*—Gregory J. Strimbu
(74) *Attorney, Agent, or Firm*—Quarles & Brady LLP

(57) ABSTRACT

A shower door system has a compression mounting system including a horizontal header and curb and upright jambs. The header and curb each include one or more rails mounted above and below the door via associated expansion assemblies. These assemblies have threaded shafts that engage one or more nuts mounted to the rails such that turning the shafts applies compressive forces against opposing end walls of a shower enclosure.

13 Claims, 5 Drawing Sheets

COMPRESSION MOUNTING SYSTEM FOR SHOWER DOORS

CROSS-REFERENCE TO RELATED APPLICATION

This application is a divisional of U.S. patent application Ser. No. 09/846,010 filed Apr. 30, 2001, now U.S. Pat. No. 6,701,672.

STATEMENT OF FEDERALLY SPONSORED RESEARCH OR DEVELOPMENT

Not applicable.

BACKGROUND OF THE INVENTION

The present invention relates to a shower and tub enclosure door system and in particular to an adjustable mounting system for such doors.

Shower and tub enclosures typically have a back wall, two end walls and an opening therebetween. To prevent water from splashing onto the bathroom floor when showering, the opening is ordinarily closed by a curtain or door allowing ingress into the enclosure. Shower curtains are generally less costly than doors, but provide less sealing around the edges of the opening and usually need to be replaced after extended use. Depending on the size of the opening, shower door systems will usually include a single, hinged or pivoting door or a pair of track-mounted sliding by-pass doors.

In either case, conventional shower door systems must be sized to fit in the enclosure opening. Many enclosure openings are of standard dimensions, however, this is not always the case. Shower door manufacturers often need to specially manufacture the door assembly according to the size of individual enclosures, which is costly. Alternatively, various elements (such as the header track) of standard sized door systems could be cut down, either by the manufacturer or consumer, according to the dimensions of the opening. However, if cut too short, the trimmed item could be unusable such that it would have to be replaced, thereby delaying installation and adding cost.

Adjustable shower door systems have been developed that allow the doors to be mounted in shower enclosure openings within a range of dimensions. For example, U.S. Pat. No. 4,035,957 provides a shower door system with a frame that can be adjusted in width to support a pivoting door panel. The upper and lower cross-members have telescoping profiles that can be moved relative to each other as needed to vary the overlap between a fixed panel and the pivoting door panel. The outer ends of the cross-members are mounted to the enclosure walls and the frame is secured together with the door pivots in the adjusted position. While this system provides adjustment, it is not suitable for both pivoting and sliding doors, and it must be anchored to the walls of the enclosure, which damages the surfaces of the enclosure walls, which are often tiled.

U.S. Pat. Nos. 4,286,343; 5,033,132 and 5,822,810 provide other adjustable systems for closing openings in shower and tub enclosures. However, they are all designed for collapsible screens or curtains, rather than rigid door panels, be it pivoting or by-pass. Moreover, the system of the '343 patent mounts the roll-up screen in a vertical orientation and the systems of the '132 and '810 patents must be permanently anchored to the walls. Further, the system of the '862 patent provides a curtain support with a header rail connected to end assemblies having spring biased plungers that press against opposing walls of the enclosure to secure the curtain support in place. Although the spring biased plungers accommodate minor variance in width of the enclosure opening, the curtain rail must be cut down to adjust the width of the curtain support. As with the others, this system is also not suitable to support rigid door panels.

Thus, an improved shower and tub door system is needed.

SUMMARY OF THE INVENTION

The invention provides an adjustable door system that is mounted horizontally across the opening of a shower and tub enclosure by compressive forces exerted by one or more threaded expansion assemblies.

In one aspect the invention provides a mounting assembly for mounting a door at an opening of an enclosure between opposite walls. The mounting assembly includes a header rail mounted by an adjustable header expansion assembly and one or more curb rails mounted beneath the header rail by an adjustable curb expansion assembly. Preferably, there are two curb rails, one at each end of the curb expansion assembly. The header and curb expansion assemblies each have a shaft and one or more nuts in threaded engagement that are coupled to the associated rail. The shaft or nut can be rotated relative to one another for mounting the rail to the enclosure by applying opposing compressive forces on the walls.

In a preferred form, the header expansion assembly has a shaft with an externally threaded end threaded into a nut and a notched end engaging a clamp in a snap fit. The nut mounts to the header rail tightly in a press fit (interference fit). The curb expansion assembly has a curb shaft and two curb nuts in threaded engagement and coupled to inner ends of two curb rails positioned on each side of the curb expansion assembly. The curb shaft has left hand threads and the other end has right hand threads such that rotating the curb shaft moves the curb nuts with respect to the curb shaft in opposite directions. Elongated header and curb stiffening members mount to respective header and curb rails.

In another preferred form, an extruded cap overlaps the header rail to conceal the header expansion assembly. Also, a second cap can be fit over the end of the header rail opposite the compression assembly.

Another aspect of the invention provides a by-pass shower door assembly including a pair of door panels mounted to the horizontal header and curb via parallel tracks in the header. A snap-on center guide with parallel upwardly opening tracks for receiving bottom ends of the door panels covers the curb expansion assembly.

One object of the invention is a door system that can be mounted over an opening in a shower and tub enclosure without damaging the mounting surfaces of the enclosure. The header and curb are mounted by rotating the shafts such that the header and curb expand outward and press against either the walls of the enclosure of the jambs.

Another object of the invention is a door assembly that can be mounted in enclosure openings of various widths. In one embodiment, the threaded compression assemblies provide approximately two to three inches of width adjustment.

Yet another object of the invention is a shower door mounting system that does not require the head or curb rails to be cut down for installation. Thus, the consumer or installer will not inadvertently cut the rails too short, which can happen particularly when the header and curb rails are to be different lengths. The provided width adjustment also reduces the number of header or curb rail sizes required to be manufactured and inventoried.

Still another object of the invention is a quick and simple and to install mounting system. The header and curb can be secured to the enclosure without tools (or with only a screwdriver or wrench for tightening the shafts). The caps and center guide concealing the compression assemblies simply can be slide on or snapped onto the corresponding rails.

These and other advantages of the invention will be apparent from the detailed description and drawings.

DETAILED DESCRIPTION OF THE PREFERRED EMBODIMENT

Figure 1:
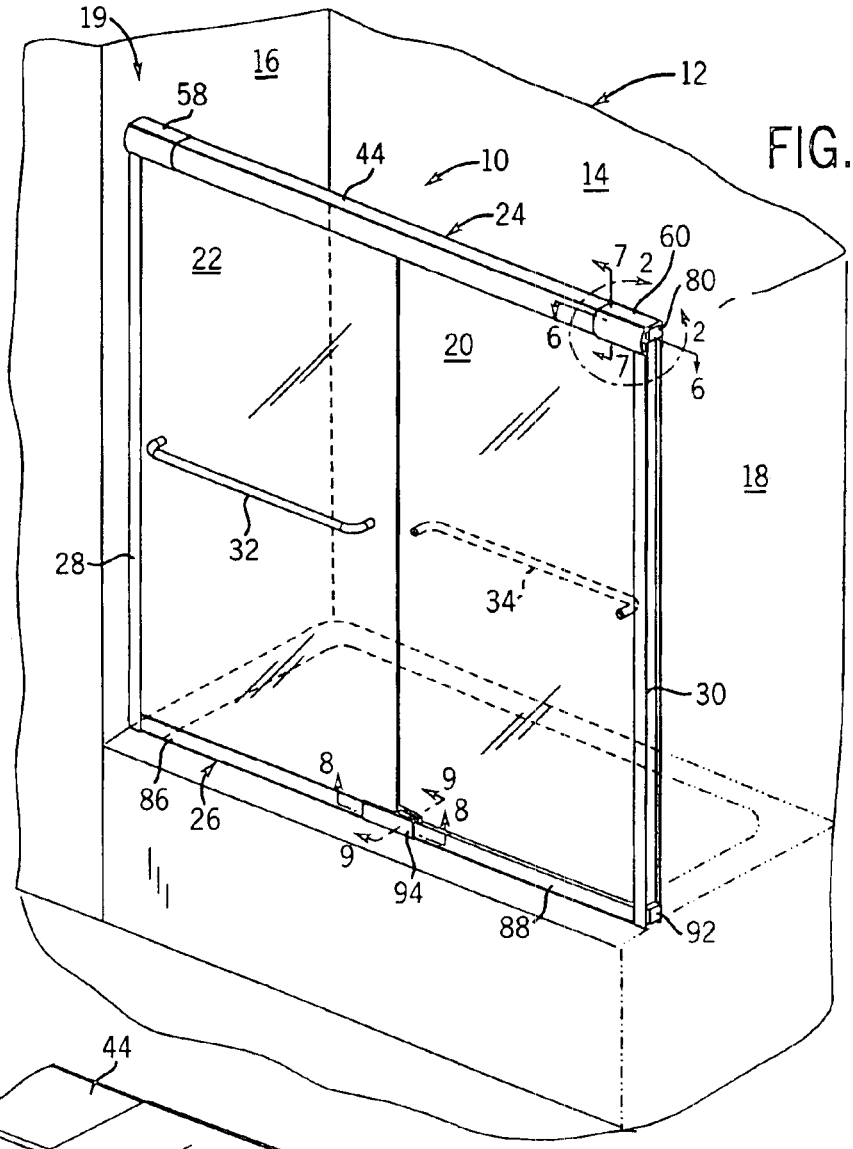
FIG. 1 is a perspective view of a shower door system having the compression mounting system of the present invention.

Referring to FIG. 1, the present invention provides a shower door system 10, shown and described herein to be of sliding by-pass style, for a shower and tub enclosure 12 defined by a back wall 14 and opposite end walls 16 and 18 with an opening 9 therebetween. The shower door system 10 includes as primary components two glass door panels 20 and 22, a header assembly 24, a curb assembly 26 and upright wall jambs 28 and 30. The unique system can be adjusted to fit variously sized enclosure openings without cutting one or more components. Moreover, the system can be securely mounted to the shower enclosure without damaging the abutting walls of the enclosure.

Figure 3:
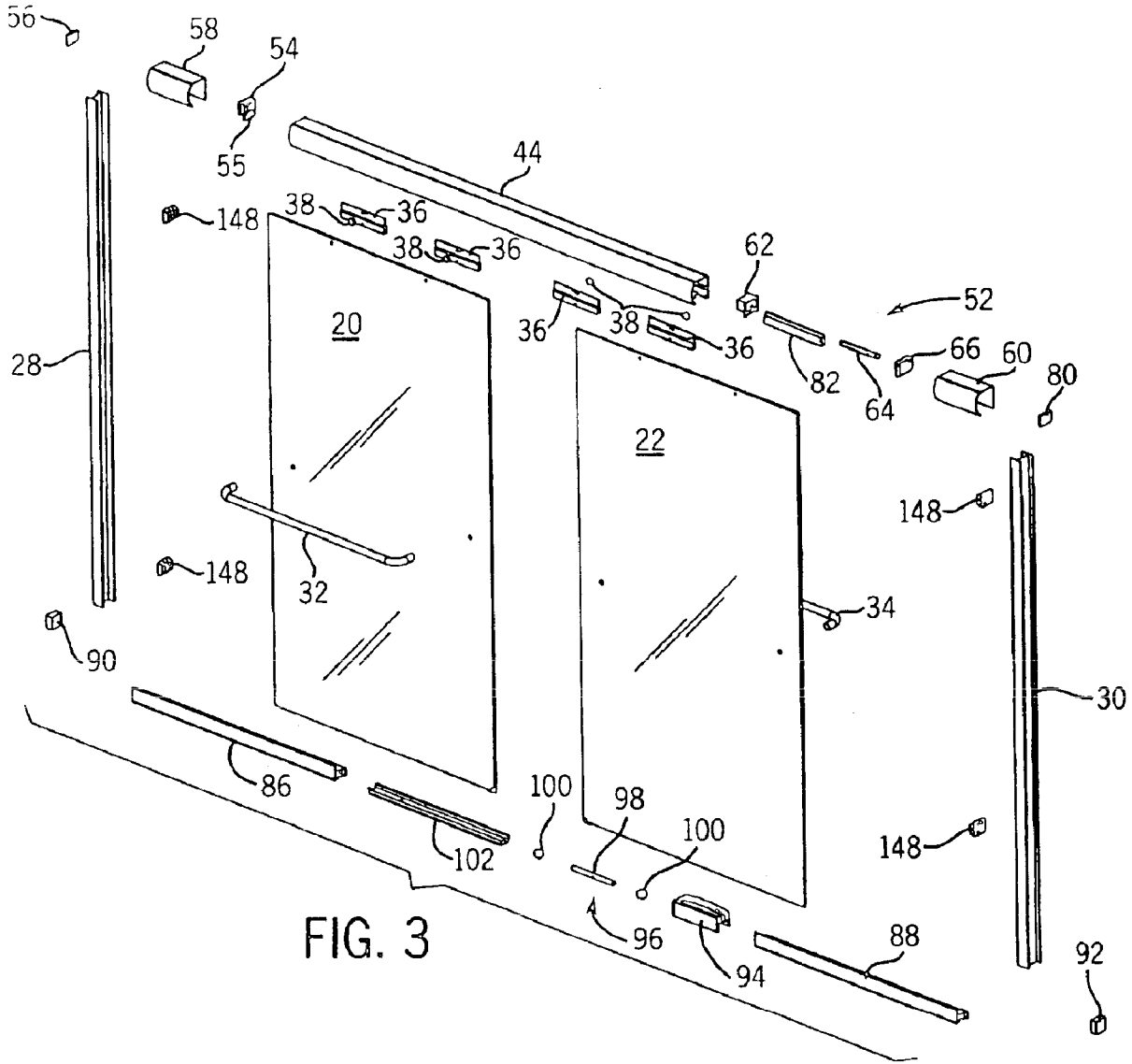
FIG. 3 is an exploded perspective of the door system.
Figures 4, 5:
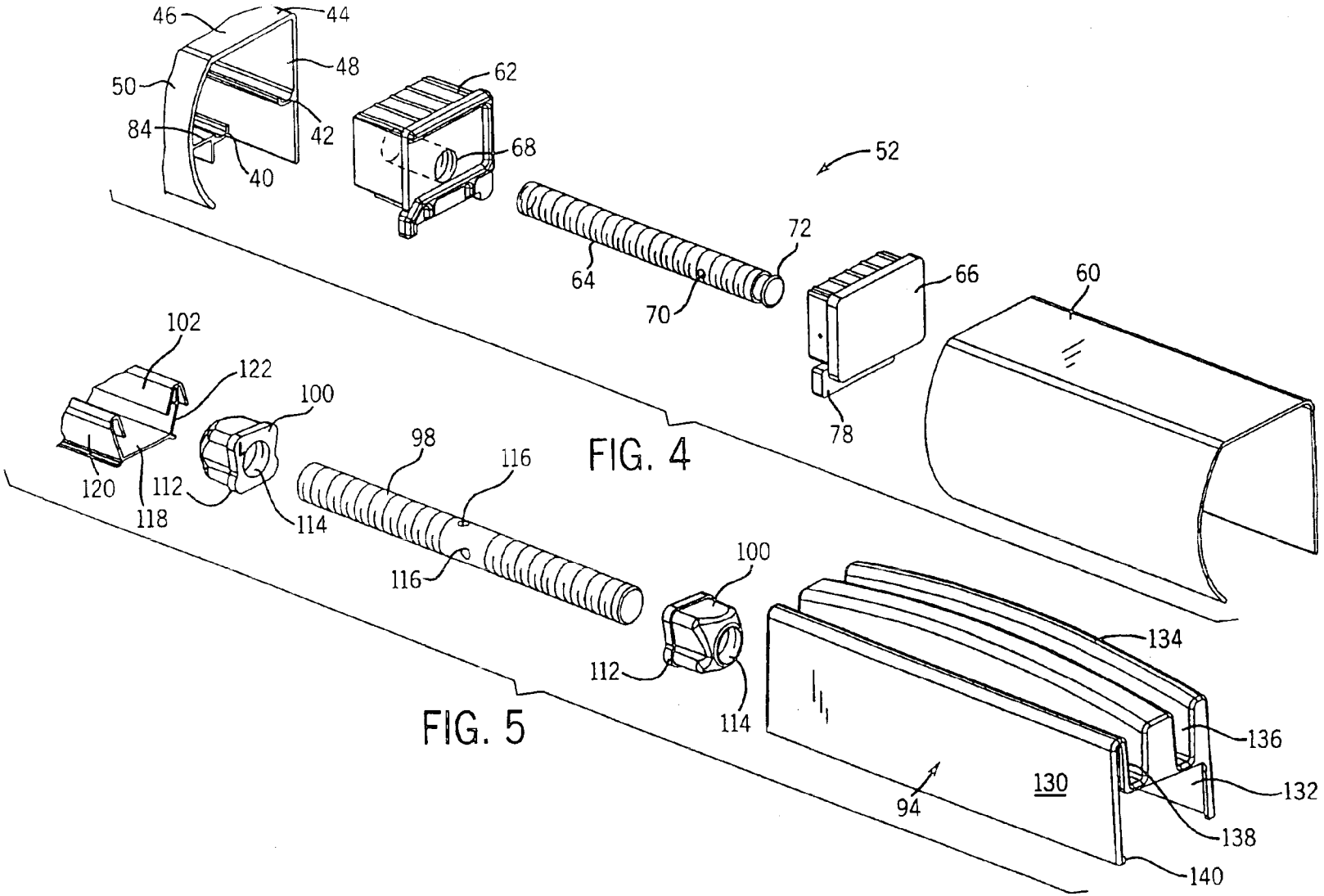
FIG. 4 is an enlarged view of the header expansion assembly.
FIG. 5 is an enlarged view of a curb expansion assembly.

FIG. 3 shows an exploded perspective view of the door system 10. As shown therein, towel racks 32 and 34 are mounted to the door panels 20 and 22 at outer and inner sides thereof, respectively. Mounted at the top of each door panel 20 and 22 are two hanger assemblies 36 with rollers 38 that ride along parallel outer 40 and inner 42 tracks of a header rail 44 of the header assembly 24 (see FIG. 7). The tracks 40 and 42 have upwardly opening grooves sized to cup the rollers 38.

Figure 2:
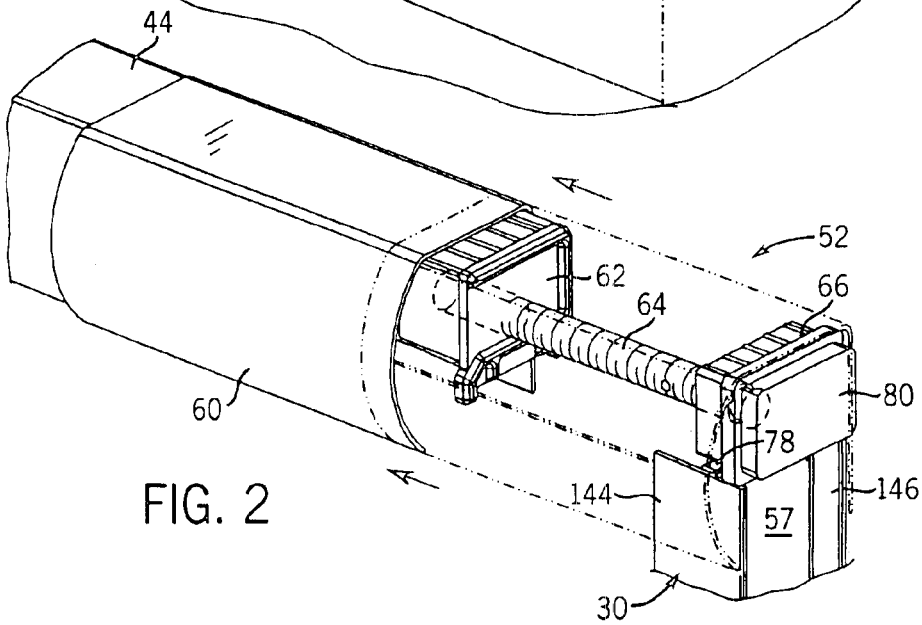
FIG. 2 is an enlarged view of one end of a header with a cap removed to reveal a header expansion assembly (shown with a header stiffening member removed)

The header rail 44 is preferably an extruded aluminum having a uniform cross-section with flat top 46 and back 48 walls and a rounded nose 50. At one end of the header rail 44 is a header expansion assembly 52 and at the opposite end is plugged by a clamp 54 having a non-slip pad 56 adhered to an outer surface. One side of the clamp 54 has a cross-section sized to mate with the header rail 44 in a press fit. The clamp 54 also has a downwardly extending tab 55 that engages the inner surface of a cross-member 57 of wall jamb 28. The clamp 54 and the header expansion assembly 52 are concealed by respective caps 58 and 60 that overlap the ends of the header rail 44. As shown in FIG. 2, the caps 58 and 60 can be slid inwardly over the header rail 44 to access the components at the ends of the header rail 44.

Referring to FIGS. 2–4 and 6–7, the header expansion assembly 52 has a nut 62, threaded shaft 64 and a snap-on clamp 66. The nut 62 is sized so that one end fits into the end of the header rail 44 in a tight, press fit. The nut 62 thus plugs the end of the header rail 44 to prevent the glides 36 from rolling off the tracks 40 and 42. The nut 62 is flanged to prevent it from being pressed too far into the header rail 44. The nut 62 has an internally threaded axial opening 68 therethrough that engages ACME (square) threads about the periphery of the shaft 64. The shaft 64 has a radial opening 70 for inserting a lever arm of some kind (such as a screw driver or hex wrench) for rotating the shaft 64. If desired, the opening 70 could be replaced by a hex feature for turning the shaft 64 with a wrench. One end of the shaft 64 has a circumferential ring 72 that can be forced past a ridge 74 in an axial recess 76 in the clamp 66 so as to be snapped onto the end of the shaft 64. The clamp 66 also has a downwardly extending tab 78 that engages the inner surface of a cross-member 57 of wall jamb 30 and a non-slip pad 80 adhered to it an outer surface.

Figure 6:
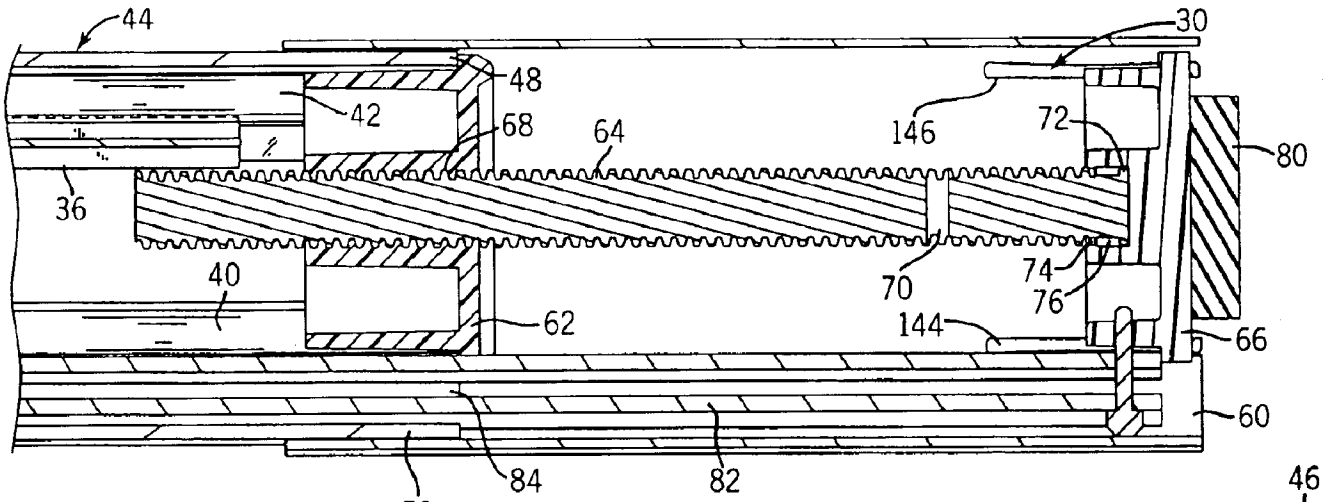
FIG. 6 is a front cross-section through line 6—6 of FIG. 1 showing the header expansion assembly.
Figure 7:
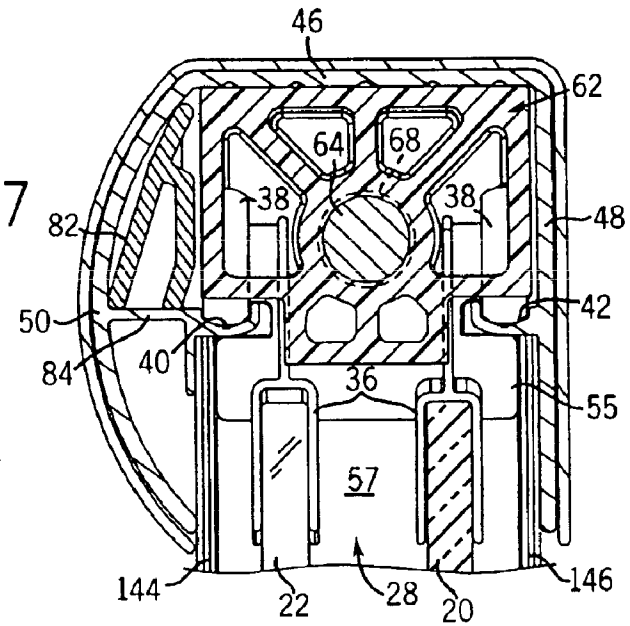
FIG. 7 is an end cross-section through line 7—7 of FIG. 1 showing the header expansion assembly.
Figure 8:
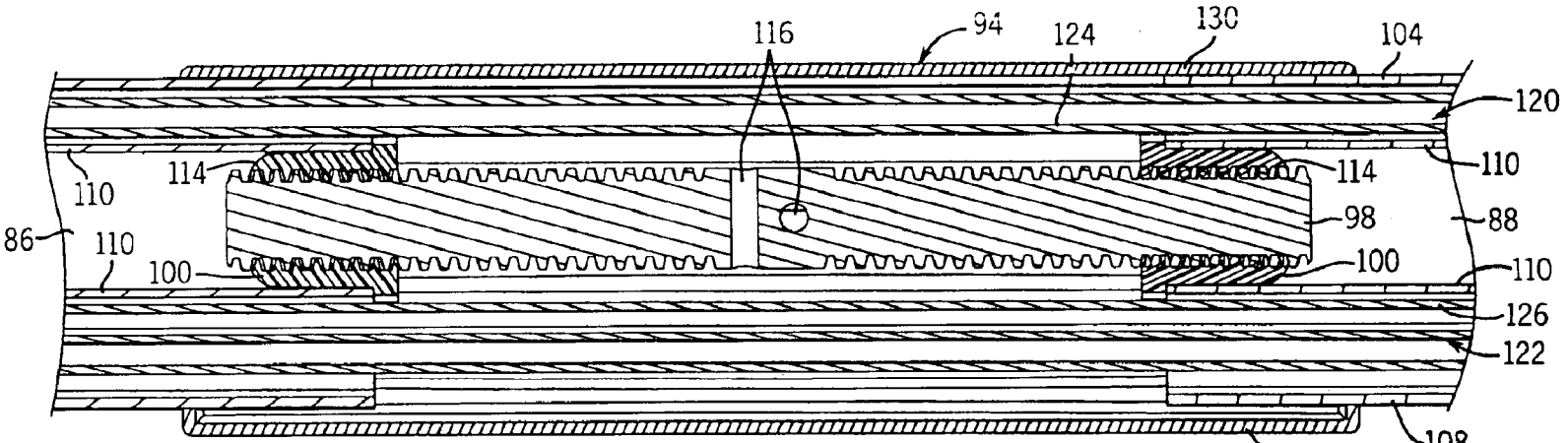
FIG. 8 is an end cross-section through line 8—8 of FIG. 1 showing the curb expansion assembly.
Figure 9:
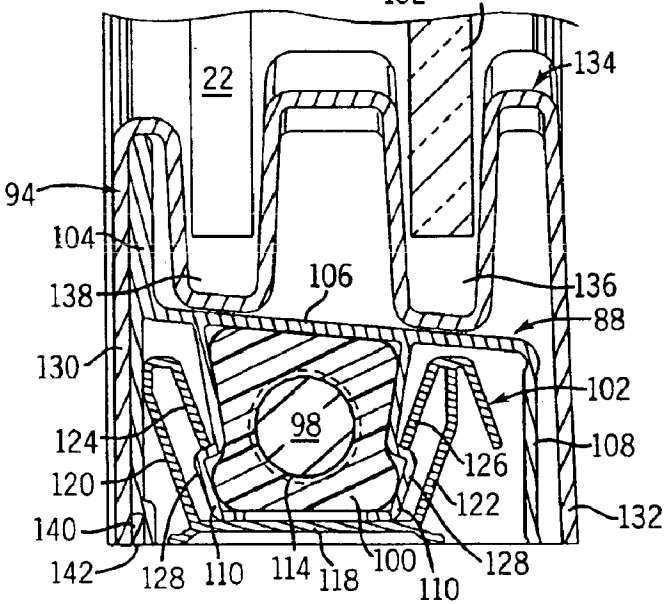
FIG. 9 is an end cross-section through line 9—9 of FIG. 1 showing the curb expansion assembly and door guide.

A stiffening member 82 (see FIGS. 3 and 7) is disposed alongside the header expansion assembly 52. The stiffening member 82 rests on a ledge 84 extending from the nose 50 and the outer track 40 of the header rail 44. One end of the stiffening member 82 is confined by the ledge 84, the nose and the nut 62 but can slide with respect to the header rail 44. The other end of the stiffening member 82 is fixed to the clamp 66 by a screw 85 (as shown in FIGS. 6 and 7. The stiffening member 82 is made of a rigid material to prevent bowing and flexing of the header assembly 24, particularly at the header expansion assembly 52.

Referring now to FIGS. 3, 5, 8 and 9, the curb assembly 26 includes a pair of curb rails 86 and 88, a center guide 94, a curb expansion assembly 96, having a turnbuckle shaft 98 and two nuts 100, and a stiffening member 102. The curb rails 86 and 88 are preferably an extruded aluminum having a uniform cross-section defining a front lip 104, a top ledge 106, a rear wall 108 and inner walls 110. The front lip 104 extends up past the bottom edge of the door panels 20 and 22 to prevent water passing thereunder from splashing onto the floor. The ledge 106 slopes downwardly toward the inside of the enclosure so that water splashed thereon will run into the enclosure.

The curb rails 86 and 88 are joined in the center by the curb expansion assembly 96. Specifically, the nuts 100, having a profile corresponding to the configuration of the inner walls 110, are pressed tightly between the inner walls 110, until their flanges 112 contact the ends of the curb rails 86 and 88. The nuts 100 have internally threaded axial openings 114 therethrough for engaging the threads of the turnbuckle shaft 98, which has left-hand and right-hand square threads on opposite ends. The middle of the turnbuckle shaft 98 has two radial passages 116 therethrough for inserting a tool for rotating the shaft. As with the header assembly, these passages could be replaced with a hex feature for turning the shaft with a wrench. Turning the shaft in one direction threads both ends of the turnbuckle shaft 98 into the nuts 100 to shorten the width of the curb assembly 26; turning it the opposite direction will drive the turnbuckle shaft 98 out of the nuts 100 so as to increase the width of the curb assembly 26.

The stiffening member 102 runs beneath the curb expansion assembly 96 and inner ends of the curb rails 86 and 88 where it engages the inner walls 110 to prevent bowing and flexing of the curb assembly 26. The stiffening member 102 has a generally flat bottom 118 with front 120 and back 122 upright walls with downwardly and inwardly extending ends 124 and 126, respectively, that clip around shoulder portions 128 of the inner walls 110 so that it can snap on to the ends of the curb rails 86 and 88. The stiffening member 102 can slide with respect to the inner walls 110 (and thus the curb rails 86 and 88) as needed when the width of the curb assembly 26 is adjusted.

The stiffening member 102, curb expansion assembly 96 and inner ends of the curb rails 86 and 88 are covered by the center guide 94. The center guide 94 has upright front 130 and rear 132 walls and a top 134 defining a pair of bottom tracks 136 and 138 for the door panels 20 and 22, respectively. The front wall 130 has an inwardly directed rib 140 along its bottom edge sized to fit into a narrow channel 142 in the curb rails 86 and 88. (see FIGS. 5 and 9). This allows the center guide 94 to be snapped onto the curb rails 86 and 88 over the curb expansion assembly 96.

Turning now to FIG. 3, the wall jambs 28 and 30 have spaced front 144 and rear 146 legs on each side of the cross-members 57, so that they form an H-shaped cross-section. The legs 144 and 146 overlap the outer edges of the door panels 20 and 22 when they are closed to prevent water from splashing onto the floor. At the bottom of the wall jambs 28 and 30, the legs 144 and 146 include a concave radius designed to accommodate the rounded, upwardly extending lips at the edges of conventional tubs. This eliminates the need to file or cut the jambs 28 and 30 during installation. Preferably, one or more bumpers 148 are fit between the legs 144 and 146 and secured to the cross-members 57 of the wall jambs 28 and 30 by suitable fasteners (not shown) to absorb the impact of the doors. To improve water barrier performance and increase rigidity, a suitable sealant, such as a silicon based caulk, can be applied along the bottom front edges of the curb rails 86 and 88 and the outer edges of the wall jambs 28 and 30 (and the upper front edge of the head rail 44 if applicable). Additionally, non-slip pads 90 and 92 are adhered to the cross-members 57 at the bottom of the wall jambs 28 and 30 adjacent the outer ends of the curb rails 86 and 88.

With reference to FIGS. 1 and 3, to install the door system 10 in a typical shower and tub enclosure 12, each of the header 24 and curb 26 assemblies are first pre-assembled. This can be done at the installation site, however, preferably it is done at the factory so that the door system ships pre-assembled and ready for installation. In any event, the header assembly 24 is assembled by pressing the clamp 54 and nut 62 into the ends of the header rail 44 and the caps 58 and 60 are slid onto the ends. The header shaft 64 is threaded into the nut 62 and the clamp 66 is snapped onto the free end of the shaft 64. The stiffening member 82 is than slid into the header rail 44 and fastened to the clamp 66. The curb assembly 26 is assembled by threading the nuts 100 onto the turnbuckle shaft 98 and pressing the nuts 100 into the inner ends of the curb rails 86 and 88. The stiffening member 102 is snapped onto the inner walls 110 of the curb rails 86 and 88 beneath the turnbuckle shaft 98.

After pre-assembly, the wall jambs 28 and 30 are set onto the front wall of the bath tub against the end walls 16 with the bumpers 148 and non-slip pads 90 and 92 already mounted to the cross-members 57. The header 24 and curb 26 assemblies are then secured in place one at a time by tightening the shafts 64 and 98 by hand, or with a screw-driver fit through the radial passages therein. As the header assembly is expanded, the tabs of the header clamps are pressed against the wall jamb cross-members 57 and the non-slip pads 56 and 80 contact the end walls 16 and 18. As the curb assembly is expanded, the outer ends of the curb rails 86 and 88 are pressed against the wall jambs with the pads 90 and 92 therebetween. Once sufficiently tightened, the assemblies will be held in place by compressive forces acting axially outward on the end walls 16 and 18. In a preferred embodiment, the width of the door system can be adjusted roughly two to three inches so as to fit a range of enclosure openings.

The caps can then be slid outward to cover the ends of the header assembly including the header expansion assembly and the center guide 94 can be snapped onto the curb rails over the curb expansion assembly. With the hanger assemblies 36 in place, the door panels 20 and 22 can be mounted in the tracks 40 and 42 from inside the enclosure. With both doors moved to one side of the opening, the center guide 94 can be slid beneath the doors and snapped onto the curb rails over the curb expansion assembly.

Installation is then completed by attaching the towel racks 32 and 34 to the doors with the provided screws and by applying a bead of caulk (or other sealant) around the assembly where it meets the tub and walls of the enclosure.

In one preferred embodiment, the header 44 and curb 86 and 88 rails and caps 58 and 60 as well as the stiffening members 82 and 102, wall jambs 28 and 30, door glides 36 and towel racks 32 and 34 are preferably extruded aluminum. The header clamps 54 and 66 as well as the header nut 62 and the curb nuts 100 are preferably a suitable plastic with low moisture absorption and capable of sustaining compressive loads, such as Noryl®. The header shaft 64 and the curb turnbuckle shaft 98 are preferably aluminum and the center guide 94 is preferably an ABS plastic with a brushed chrome electroplated finish. The door panels 20 and 22 are preferably a tempered glass. The slip resistant pads 56, 80, 90 and 92 are preferably an extruded rubber foam and the bumpers 148 are a clear PVC.

The invention thus provides a door system that can be mounted over an opening in a bath and shower enclosure without damaging the mounting surfaces of the enclosure. The header and curb are mounted by rotating the shafts such that the header and curb expand outward and press against either the walls of the enclosure of the jambs. The door system can be mounted in enclosure openings of various widths. The threaded compression assemblies provide approximately three inches of width adjustment. Moreover, the shower door mounting system does not require the head or curb rails to be cut down for installation, thus simplifying installation and reducing errors. And, the header and curb assemblies can be secured to the enclosure with minimal or no tools.

A preferred embodiment of the invention has been described in considerable detail. Many modifications and variations to the preferred embodiment will be apparent to those skilled in the art, which will be within the spirit and scope of the invention. Therefore, the invention should not be limited to the described embodiment. To ascertain the full scope of the invention, the following claims should be referenced.

INDUSTRIAL APPLICABILITY

The invention provides a non-destructive, compressive shower door mounting system.

What is claimed is:

1. A mounting assembly for mounting a movable door panel at an opening of an enclosure between opposite walls of the enclosure, comprising:

a horizontal header rail mountable at the opening above the door panel;

an adjustable header expansion assembly having a shaft extending longitudinally relative to the rail and a nut in threaded engagement with the shaft, said nut disposed within the header rail such that the shaft and nut can be rotated relative to one another to expand the header expansion assembly and increase the length of the header rail for mounting the header rail to the enclosure by opposing compressive forces acting on the walls; and a curb rail having two rails positioned at opposite ends of a curb expansion assembly for mounting the curb rail to the enclosure beneath the header rail, wherein the curb expansion assembly has a curb shaft and a curb nut in threaded engagement and coupled to the curb rail.

2. The assembly of claim 1, wherein the curb expansion assembly includes a second curb nut, said curb nuts threaded at opposite externally threaded ends of the curb shaft.

3. The assembly of claim 2, wherein the curb nuts mate with inner walls of the curb rails.

4. A mounting assembly for mounting a movable door panel at an opening of an enclosure between opposite walls of the enclosure, comprising:

a horizontal header rail mountable at the opening above the door panel;

an adjustable header expansion assembly having a shaft and a nut in threaded engagement, said header expansion assembly coupled to the header rail such that the shaft and nut can be rotated relative to one another for expanding the header expansion assembly and mounting the header rail to the enclosure by opposing compressive forces acting on the walls; and a curb rail having two rails positioned at opposite ends of a curb expansion assembly for mounting the curb rail to the enclosure beneath the header rail, wherein the curb expansion assembly has a curb shaft and a curb nut in threaded engagement and coupled to the curb rail;

wherein the curb expansion assembly includes a second curb nut, said curb nuts threaded at opposite externally threaded ends of the curb shaft;

wherein the curb nuts mate with inner walls of the curb rails;

wherein one of said threaded ends of the curb shaft has left hand threads and the other of said threaded ends of the curb shaft has right hand threads such that rotating the curb shaft moves the curb nuts with respect to the curb shaft in opposite directions.

5. The assembly of claim 4, further comprising a guide covering the curb expansion assembly.

6. The assembly of claim 5, further comprising a curb stiffening member adjacent the curb expansion assembly.

7. The assembly of claim 6, wherein the curb stiffening member can slide with respect to the curb rails.

8. The assembly of claim 4, wherein the header rail has a track for suspending the door panel.

9. The assembly of claim 4, further comprising a guide defining an upwardly opening track for receiving a bottom end the door panel.

10. The assembly of claim 4, wherein the assembly is suitable to mount a second door panel in addition to the aforesaid door panel.

11. The assembly of claim 11, further comprising a guide defining a two upwardly opening tracks for receiving bottom ends of the door panels.

12. The assembly of claim 11, wherein the header rail has two parallel tracks for suspending the door panels.

13. The assembly of claim 4, wherein at least one of the header and curb shafts has a tool receptor.

* * * * *